US005212858A

United States Patent [19]

Anderson

[11] Patent Number: 5,212,858

[45] Date of Patent: May 25, 1993

[54] APPARATUS FOR CAPTURING AND STABILIZING A YARN

[75] Inventor: Larry D. Anderson, Appleton, Wis.

[73] Assignee: Asten Group, Inc., Charleston, S.C.

[21] Appl. No.: 713,961

[22] Filed: Jun. 11, 1991

Related U.S. Application Data

[63] Continuation of Ser. No. 472,734, Jan. 31, 1990.

[51] Int. Cl.[5] ..... D06H 5/00

[52] U.S. Cl. ..... 28/141

[58] Field of Search ..... 28/140, 141, 271, 273; 57/350, 22, 261, 263; 139/1 R, 7 D, 116.2, 444, 445, 447, 450, 170.3, 256 A

[56] References Cited

U.S. PATENT DOCUMENTS

| | | | |
|---|---|---|---|
| 1,079,470 | 11/1913 | Colman . | |
| 1,082,474 | 12/1913 | Colman . | |
| 1,779,312 | 10/1930 | Hammer . | |
| 2,011,115 | 8/1935 | Peterson | 28/49 |
| 2,039,157 | 4/1936 | Fleischer | 28/49 |
| 2,449,691 | 9/1948 | Deal | 139/33.5 |
| 2,523,932 | 9/1950 | Abbott | 139/1 |
| 2,630,143 | 3/1953 | Kennedy | 139/256 A |
| 2,808,076 | 10/1957 | Moseley et al. | 139/256 A |
| 2,959,909 | 11/1960 | Sutherland et al. | 28/271 X |
| 2,960,118 | 11/1960 | Ancet et al. | 139/445 |
| 3,059,867 | 10/1962 | Fürst | 139/256 A |
| 3,175,588 | 3/1965 | Angle | 139/256 A X |
| 3,421,194 | 1/1969 | Breen et al. | 28/271 |
| 3,990,732 | 11/1976 | Reichert | 289/2 |
| 4,121,409 | 10/1978 | Uchida et al. | 57/22 |
| 4,175,307 | 11/1979 | Altenweger | 28/211 |
| 4,194,538 | 3/1980 | Borodin et al. | 139/194 |
| 4,410,015 | 10/1983 | Koller et al. | 139/383 |
| 4,557,025 | 12/1985 | Eglin | 28/141 |
| 4,581,794 | 1/1989 | Oldroyd et al. | 28/141 |
| 4,860,411 | 8/1989 | Vohringer | 28/141 |
| 4,862,566 | 9/1989 | Hacker | 28/141 |
| 4,866,821 | 9/1989 | Hacker et al. | 28/141 |
| 5,062,261 | 11/1991 | Fink | 57/350 X |

*Primary Examiner*—Werner H. Schroeder
*Assistant Examiner*—John J. Calvert
*Attorney, Agent, or Firm*—Volpe and Koenig

[57] ABSTRACT

An apparatus for capturing and stabilizing yarn prior to interweaving thereof. The apparatus is comprised of a generally tubular body having an open end, an open side and a generally vertical slot which extends between the open side and the open end.

19 Claims, 4 Drawing Sheets

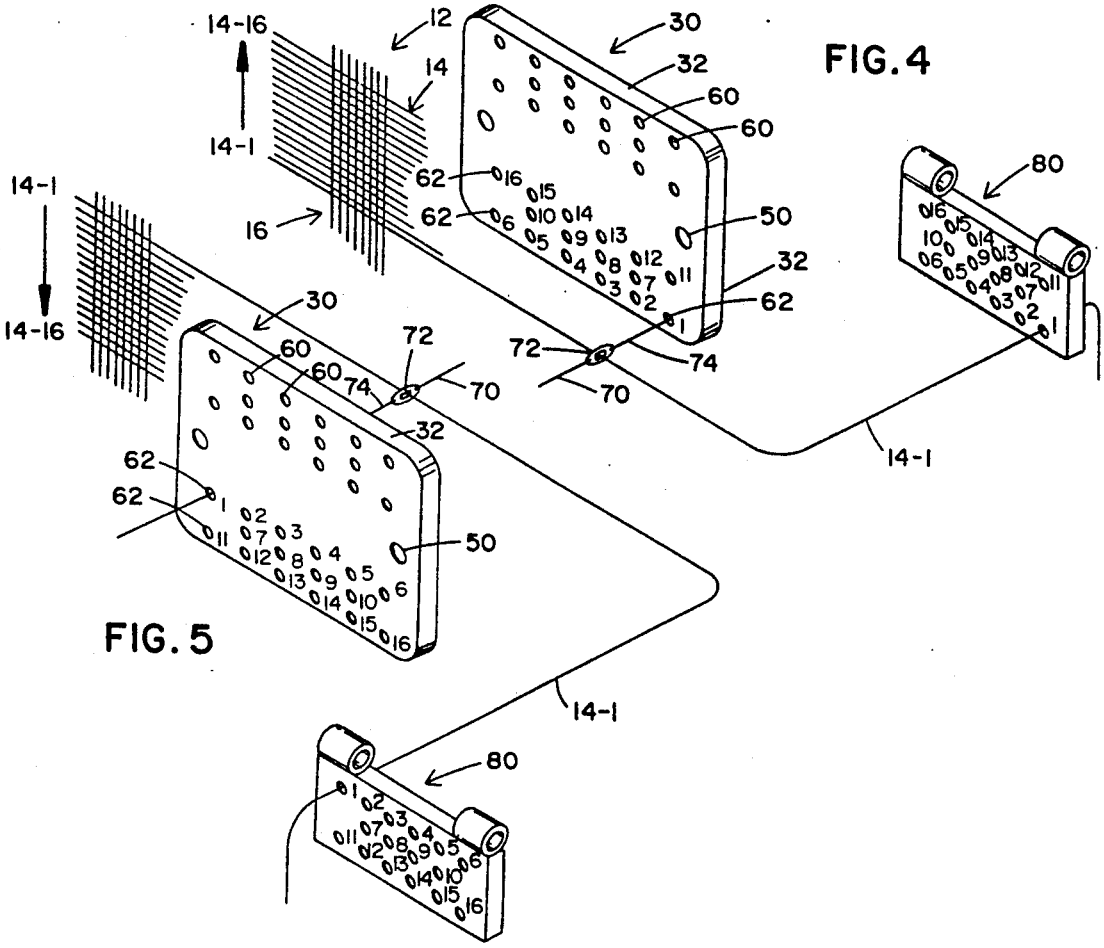
FIG. 4
FIG. 5
FIG. 6a
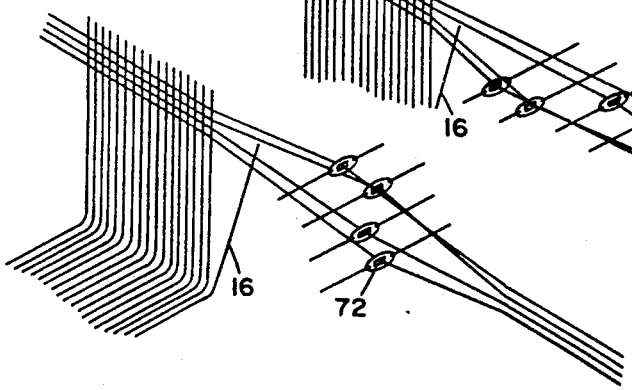
FIG. 6b

APPARATUS FOR CAPTURING AND STABILIZING A YARN

This is a continuation of application Ser. No. 07/472,734, filed Jan. 31, 1990.

BACKGROUND OF THE INVENTION

1. Field of the Invention

The present invention relates to an apparatus for use in production of a woven seam in fabric belts. More particularly, the present invention relates to an apparatus for automatically forming a woven seam in industrial fabrics of the type employed in the papermaking industry. The present apparatus is especially useful in automated seaming of papermakers fabrics used in the Fourdrinier or forming section of a paper machine.

2. Background of the Art

The art has recognized for some time the advantages to be achieved through the seaming of flat woven fabrics to render them endless, in the manner of a circular or endless woven fabric. Most recently, the art has recognized the advantages to be achieved by the use of automated equipment to weave the seam which renders a flat woven fabric endless. Two prior art attempts to economically accomplish such automated seaming are disclosed in U.S. Pat. Nos. 4,410,015 and 4,581,794. U.S. Pat. No. 4,581,794 is commonly assigned with the present invention to Asten Group, Inc. Notwithstanding the aforementioned attempts, a majority of the seaming is still accomplished by a semi-automated hand weaving operation.

A major concern of the prior art, both automatic and semi-automatic, has been the ability to select, separate, present and interweave individual threads in the proper order during seam formation. As will be recognized by those skilled in the art, it is preferred that the weave pattern in the seam area be consistent with the weave throughout the remainder of the fabric. With very simple fabrics, such as a single layer plain weave, the problem is not so acute. However, in multi-layered fabrics having more complex weaves, the problems associated with separating the proper yarn in accordance with the weave sequence is more acute.

For some time, the art has sought solutions to the problems of selecting the yarn, separating the yarn and presenting the yarn for interweaving. The present invention meets all three of these objectives.

SUMMARY OF THE INVENTION

The present invention provides an apparatus for selectively releasing tied yarns from a fringe strip. The fringe strip is comprised of a plurality of tying and tied yarns which are interwoven in a given repeat pattern.

The apparatus utilizes a shed formation means to define a shedding pattern for the fringe strip tying yarns. Through the operation of the shedding means, it is possible to manipulate the tying yarns of the fringe to selectively release a tied yarn from the strip. The manipulatior of the tying yarns is accomplished through a plurality of individual control means. As an individual tied yarn is released from the fringe strip, it is separated and presented for interweaving in the seam area. The weaving process may be a hand weaving process or one of the automated weaving process as described in the 4,410,015 or 4,581,794 patent.

BRIEF DESCRIPTION OF THE DRAWINGS

FIG. 4 illustrates the yarn threading arrangement from the left hand side of the apparatus.

FIG. 4 illustrates the yarn threading arrangement from the right side of the apparatus.

FIGS. 6*a* and 6*b* illustrate illustrates the shedding of the fringe and the release of a tied yarn.

DESCRIPTION OF THE PREFERRED EMBODIMENT

As noted previously, the present invention is suitable for use in the apparatus described in U.S. Pat. No. 4,581,794. Accordingly, this disclosure will be limited to a discussion of separating yarns from the fringe. For discussion of actual interweaving, reference should be made to U.S. Pat. No. 4,581,794 which is incorporated herein for that disclosure as if fully set forth.

Figure 1:
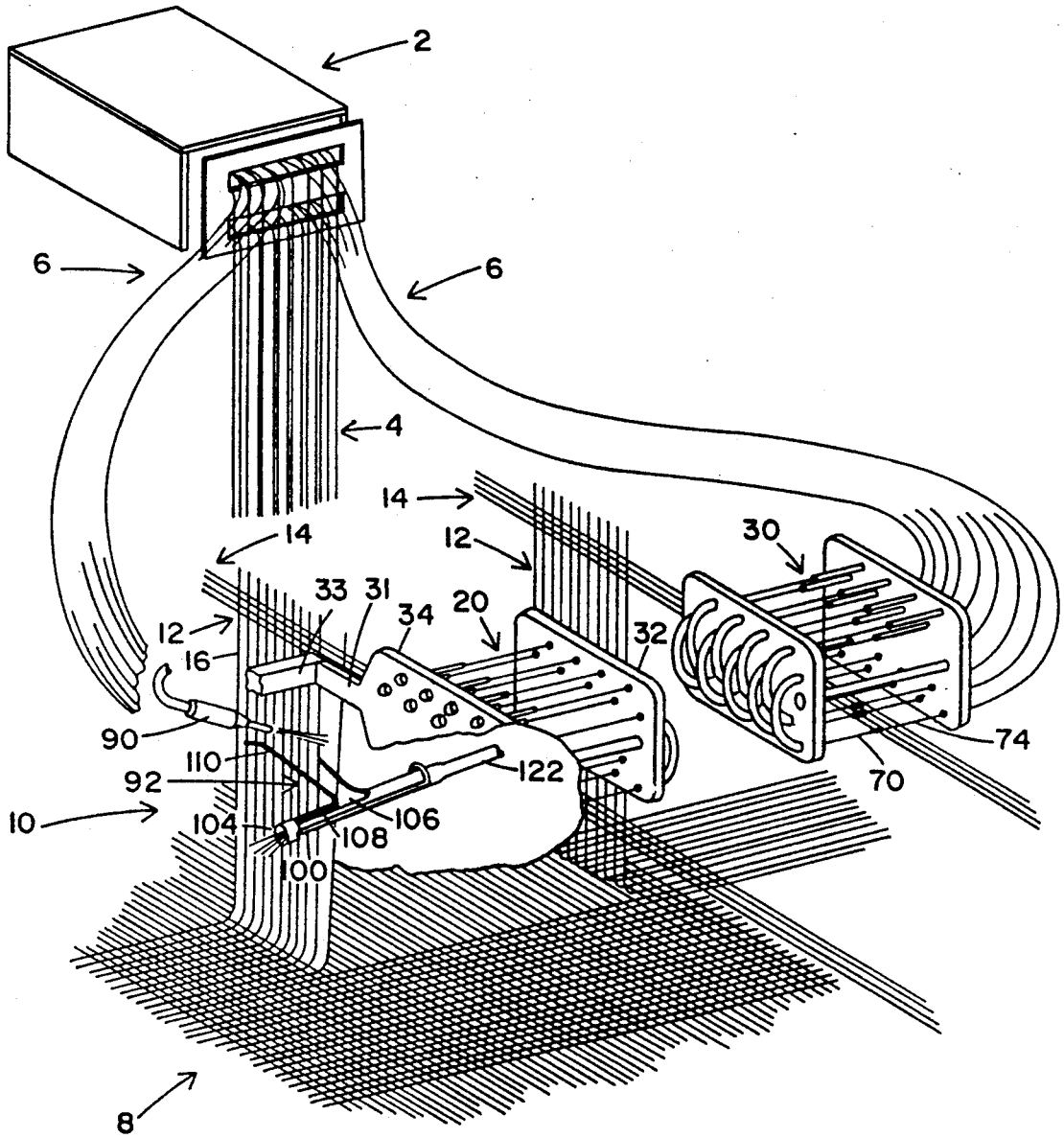
FIG. 1 is a perspective view of an apparatus in accordance with the present invention.

With reference to FIG. 1 there is shown a Jacquard machine 2 and a fabric 8 which is to be seamed. A plurality of harness cords extend from the Jacquard machine 2. The central group of harness cords 4 extend downwardly from the Jacquard machine Z to the fabric 8 which is being seamed. The harness cords 4 will control the shedding of yarns 10 in the base fabric s as the selected fringe yarn 16 is interwoven as part of the seam. In addition to the central group of harness cords 4, there are two sets of side cords 6. Each set of the side cords is assigned a respective left and right hand position. The side cords 6 extend from the Jacquard machine 2 to the respective fringe control apparatus 30 and will control the shedding of the ribbon of tying fringe yarns 14 during selective release of the tied fringe yarns 16. In their interwoven state, the tying yarns 14 and the tied yarns 16 form a fringe area 12. Since the left and right hand fringe control apparatus 20 and 30 are essentially mirror images of each other, the description thereof will be limited to one fringe control apparatus. To the extent that there are distinctions between the left and right hand sides, they will be clearly identified and described hereinafter.

Figures 2, 3:
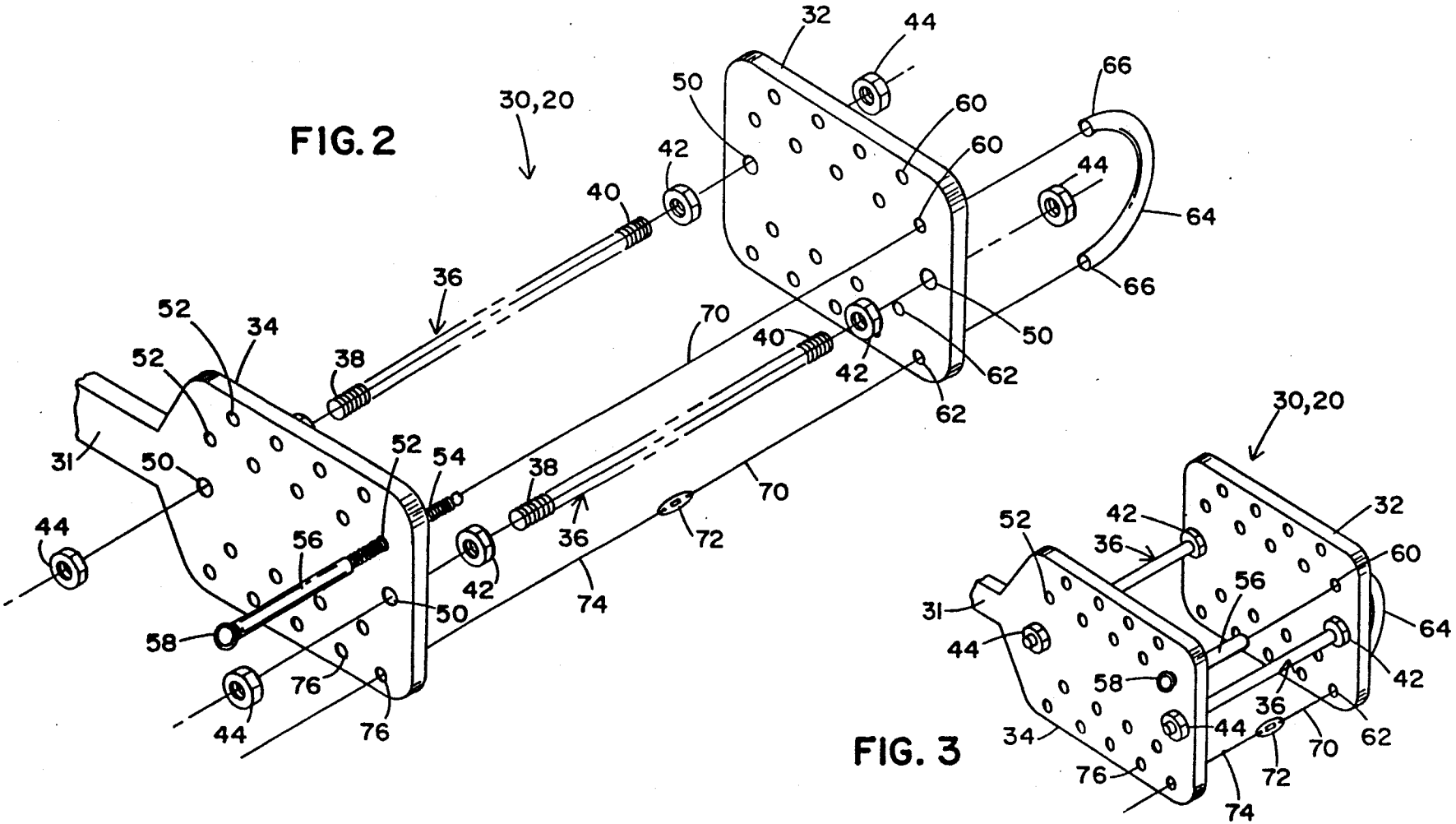
FIG. 2 is an exploded view of a yarn shedding means in accordance with the present invention.
FIG. 3 is an assembled view of the yarn shedding means depicted in FIG. 2.

Turning now to FIG. 2, the preferred fringe control apparatus 20 as it appears on the left hand side of FIG. 1 will be described in more detail. Each fringe control apparatus 20 is comprised of opposed mounting plates 32 and 34 which are spaced apart and oriented in parallel vertical planes. The distance between the mounting plates 32 and 34 is maintained by the spacing shafts 36. Each shaft 36 has an unthreaded central portion and threaded end portions 38 and 40. A nut 42 is secured to each shaft at the threaded portions 38 and 40. The nut is threaded toward the central portion and the threaded portion is then passed through the respective plate 32 or 34 at the apertures 50 and a second nut 44 secured thereto. As a result of this arrangement, it is possible to adjust the spacing between the mounting plates. While the preferred embodiment has been shown with two spacers 36, it will be understood by those skilled in the art that additional spacers may be used and the final number will depend upon the structural rigidity desired for the fringe control apparatus 20.

Mounting plates 32 and 34 have a series of apertures formed across their upper and lower portions. With reference to mounting plate 34, the upper series of apertures 52 is dimensioned to securely receive the brass sleeve 56. Within brass sleeve 56 is a spring element 54. Each spring element 54 is retained with in a respective sleeve 56 and aperture 52 by a ring 58. The opposed plate 32 has a plurality of apertures 60 which generally correspond to the apertures 52. Each aperture in the second series of apertures 62 in plate 32 is generally in vertical alignment with a corresponding aperture 60 and is substantially the same size. The apertures 60 and 62 are slightly tapered or chamfered, in the manner of a recess, as they extend through the plate 32 toward the plate 34. A semi-circular sleeve 64, with tapered ends 66, is fitted vertically between the respectively paired apertures 60 and 62. Sleeve 64 provides a raceway and turnaround for the control cord 70 as it extends between spring 54 and the mail or eyelet 72. Control cord 74 extends from the left side of eyelet 72 through the aperture 76 to the associated harness cord of side cords 6 on the left side of the Jacquard machine 2. As will be appreciated by those skilled in the art, the aperture 76 is dimensioned to accommodate cord 74. In addition, it is preferred that each aperture 76 be provided with an eyelet to reduce abrasion on the cord 74.

FIG. 3 shows the elements of FIG. 2 assembled. As can be seen with reference to FIGS. 1, 2 and 3, the fringe control mechanism is adaptable in size and, therefore, can be varied to accommodate varied shed counts. With reference again to FIGS. 1 and 2, it can be seen that plate 34 is provided with an extending arm member 31. The extending arm 31 is secured to a horizontal mounting member 33 which is securely mounted and positioned so as to locate the fringe control apparatus 20 adjacent to the fringe. In the preferred embodiment, the mount 33 is connected directly to the base of the automatic seaming apparatus. It will be understood by those skilled in the art that the variety of seaming devices presently used in the art will result in differential mounting techniques in order to avoid interference with movement of the fabric or seaming.

One of the advantages to the present invention is the fact that the carding arrangement for the Jacquard machine 2 may possess the same repeat pattern for controlling the harnesses 4 and 6. Alternatively, the repeats for the fringe harnesses 6 are the same as each other but different than that of harness 4. Stated in another way, the cards for harnesses 6 have the same repeat pattern without regard to whether or not harnesses 4 or 6 are being controlled by same card arrangement. In order to facilitate this arrangement, the tying yarns 14 are inverted as they are led into the fringe control apparatus in the respective right and left hand positions. This is explained in more detail below.

FIG. 4 will be representative of the right side apparatus 30 and FIG. 5 will representative of the left side apparatus 20. If we assume that the fabric is woven in an eight shed repeat, the ribbon of tying yarns 14 would preferably be comprised of two repeats or sixteen yarns. Accordingly, the tying yarns 14 are represented as 14-1 through 14-16. The yarns of the left side are sequenced opposite to those of the right side. With reference to FIG. 4, the first tying yarn 14-1 will be controlled by the mail 72 occupying the number 1 position in the lower right hand corner of plate 32. After yarn 14-1 has passed beyond the controlled apparatus 30, it is strung through an end ribbon control bracket so. The sequence of holes in end ribbon control bracket so is the same as that in the associated bracket 32. As will be understood by those skilled in the art, each yarn 14, after it proceeds through the bracket so, is weighted to maintain the proper tension in accordance with accepted Jacquard techniques.

With reference to FIGS. 4 and 5, it can be seen from a comparison of the two FIGURES that the yarn designations and their positions have been reversed or inverted. Accordingly, in FIG. 5 the lower right hand position is designated 16, as opposed to its previous designation as 1, and will receive the yarn 14-16. As described above, the yarn 14-16 continues through the ribbon control bracket s and is weighted.

As can be seen from a comparison of FIGS. 4 and 5, the respective yarns 14-1 through 14-16 occupy the same relative position in their respective ribbon 14 and plate 32. It is at this point that the lacing of the harness cords 6 becomes relevant. The respective harness cord 6 from each side of the Jacquard machine is laced with the respective tying yarn of ribbon 14 in accordance with the weave repeat pattern. In our example of an eight shed, positions 1 through 8 on each side of the Jacquard machine 2 would be connected to the respective positions 1 through 8 on the respective plate 32. The second repeat, 9 through 16, would be connected in a like manner.

By reference to FIGS. 6*a* and 6*b* the result of operating the Jacquard machine under the above described control is illustrated. As can be seen in these FIGURES, the ribbon 14 is manipulated or shedded in the mirror image of itself. As a result of this mirror image shedding, the proper tied yarn 16 is sequentially released from the tying yarns of the ribbon 14 and is made available for interweaving. With reference to FIG. 1, the preferred embodiment includes a pulsed air or pressure source 90 and a yarn catcher 92 to assist in liberation and capture of the tied yarn 16. As the yarn is released from the tying ribbon 14, it is preferred that a controlled burst of air be released from the pressure source 90 to direct the yarn into the yarn catcher 92. The catcher 92 momentarily stabilizes the yarn and assists in determining a fixed position for pick up of the yarn 16 as part of the interweaving process to complete the seam construction.

Figure 7:
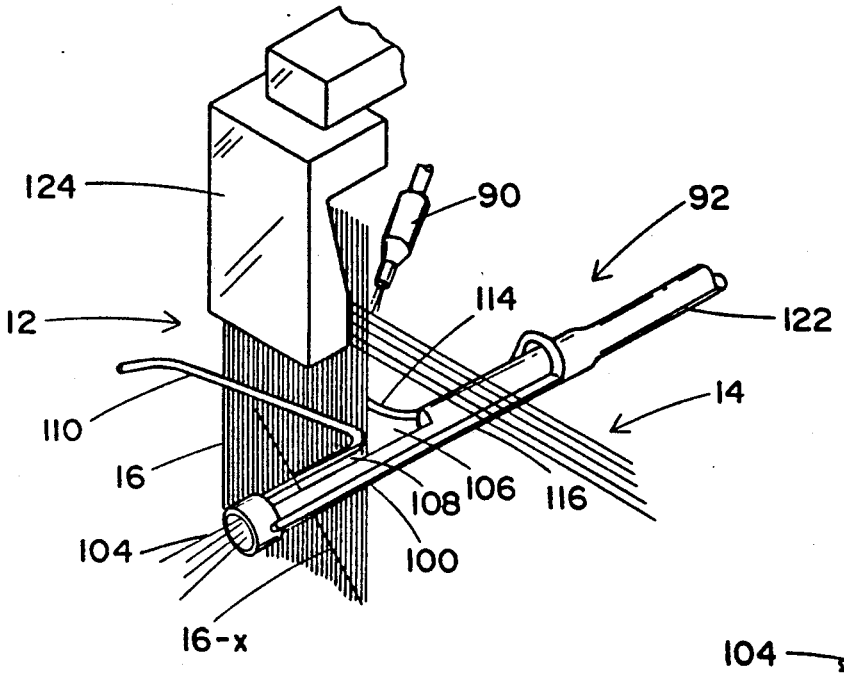
FIG. 7 illustrates a preferred means for capturing a yarn prior to interweaving.
Figure 9:
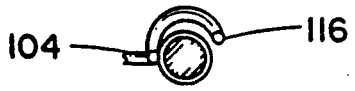
FIG. 9 is a side elevation taken in the direction of 9—9 on FIG 8.
Figure 8:
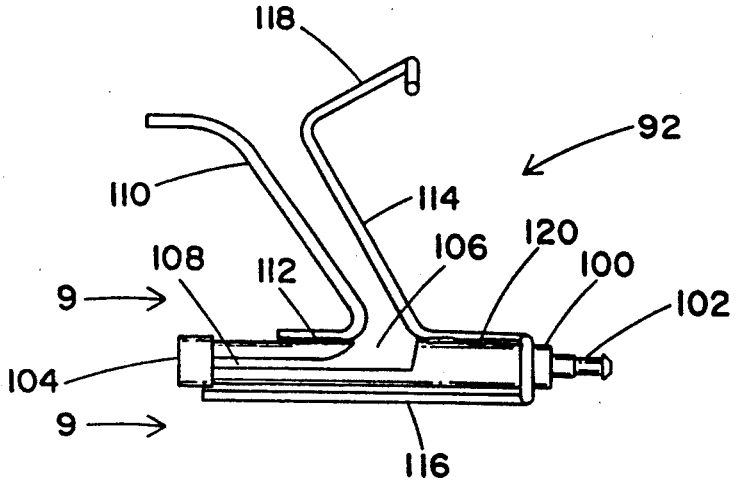
FIG. 8 illustrates a preferred capture device.

With reference to FIGS. 7, 8 and 9, a preferred location for the pressure source 90 and a preferred construction for the yarn capture 92 will be described in more detail.

With reference to FIG. 7, the pressure source 90 is preferably positioned to the inside of the yarn fringe at about the point where separation will take place. Preferably, the pressure source 90 will direct the air outwardly so that the air is expelled away from the fringe yarns and the seam area. In the preferred embodiment, the yarn catcher 92 is secured to the guide-mount 124. The guide 124 will assist in securing and positioning the free end of the fringe 12. Although principle control over the fringe 12 will be established through the ribbon 14, guide 124 has been found to be useful. Since guide 124 is positioned adjacent the seam area, it makes an ideal mount for the yarn catcher 92. As a tied yarn 16 is released, it will fall into the side opening 106 and will be blown into the slot 108. This operation can be clearly understood by reference to FIG. 8.

With reference to FIGURES, the yarn catcher 92 has a tubular body 100 which is approximately two inches in length. Tubular body 100 is closed at one end by the nipple 100; the other end 104 is open. Opening 106 in the side of tubular body 100 is approximately 0.375 inches long and communicates with a bifurcated portion forming a slot 108 which is approximately 0.75 inches long. The open side 106 is bordered by guides 110 and 114. As can be seen by reference to FIG. 7, the guides 110 and 114 will extend about tied yarns 16 of fringe area 12.

Returning to FIG. 8, an additional guide 116 is provided. Guide 116 extends parallel to the open side 106 and the slot 108 and is positioned off of the body 100 by approximately 0.125 inches. Guide 116 is about 1.875 inches long and serves a bearing for a tied yarn 16 as it is released from the fringe area 12. As can be appreciated by those skilled in the art, the released yarn will be of such a length that a portion of the free end of the yarn may extend past the body 100. In the event that the yarn rolls over the body 100, guide 116 will assure that the yarn does not become abraded in the side opening or slot. Yarn catcher 92 also has a mounting arm or stem 118 which is used to secure catcher 92 to guide-mount 124. In the preferred embodiment, guide 110 is secured to the body 100 by weldment 112. The guides 114 and 116 and the mounting arm 118 are formed from a single piece of stock which is secured to the body 100 by the weldment 120.

When tied yarn 16 is released from the tying yarns 14, it will naturally fall forward toward side opening 106 and also be urged forward by an air jet from pressure source 90. The yarn 16 will proceed through the guides and into the side opening 106. At this time, a current of air from line 122 is passed through the hollow tubular body 100. As the air passes through body 100 it will urge the released yarn 16 toward the end 104. Since the end 104 is open, the air will continue through the tube without the creation of back currents against the yarn 16. At this point, the yarn 16 has been accurately positioned and may be picked up by the weaving apparatus for interweaving into the seam of the fabric 8.

As can be appreciated by those skilled in the art, the above described device may be useful in hand, semi-automated or automated seam formation techniques. The present invention finds particular application in an automated seaming apparatus as described in U.S. Pat. 4,581,794 which has been modified to incorporate the above described apparatus for selectively releasing yarns from a fringe.

What I claim is:

1. An apparatus for capturing and stabilizing a yarn prior to interweaving thereof, said apparatus comprising a generally tubular body having at least one open end and a bifurcated portion forming a slot, a side opening, the slot communicating with said side opening, said slot extending from the side opening to the open end allowing the yarn to move between the side opening and the open end.

2. The apparatus of claim 1 further comprising a guide means positioned to direct a yarn towards the side opening.

3. The apparatus of claim 2 wherein the guide means comprises two shaped wire-like members in a generally diametrical arrangement on each side of the side opening.

4. The apparatus of claim 3 wherein one wire-like member is elongated.

5. The apparatus of claim 3 further comprising a means for preventing yarn abrasion.

6. The apparatus of claim 5 wherein the abrasion preventing means is a wire-like member, which is attached to the body at one end such that the remainder thereof is spaced from the body and runs generally parallel to the slot.

7. The apparatus of claim 6 wherein the abrasion preventing means is a continuation of one wire-like member of the guide means.

8. The apparatus of claim 1 further comprising a yarn abrasion prevention means attached to said body.

9. The apparatus of claim 8 wherein the abrasion preventing means is a wire-like member, which is attached to the body at one end such that the remainder thereof is spaced from the body and runs generally parallel to the slot.

10. The apparatus of claim 1 further comprising an air flow means which is attached to a second end of the body, and creates an air current that moves the yarn, in the slot, from the side opening towards the first open end.

11. An apparatus for capturing and stabilizing yarn prior to interweaving, said apparatus comprising a generally tubular body having at least one open end, a bifurcated portion forming a slot a side opening, the slot being generally vertical and extending between the side opening and the open end.

12. The apparatus of claim 11 wherein the apparatus includes yarn guide means positioned adjacent to and in communication with the side opening.

13. The apparatus of claim 12 wherein the guide means is comprised of at least two wire-like members which are positioned on either side of the side opening in a generally diametric arrangement.

14. The apparatus of claim 13 wherein one wire-like member is elongated.

15. The apparatus of claim 11 wherein the apparatus includes means for preventing yarn abrasion to a yarn which rolls over the tubular body.

16. The apparatus of claim 15 wherein the means for preventing yarn abrasion is a wire-like member which is attached to the tubular body at one end thereof and is configured so that the remainder of the wire-like member is spaced from the tubular body and is generally parallel to the slot which extends between the side opening and the open end.

17. An apparatus for capturing and stabilizing yarn prior to interweaving, the apparatus is comprised of a generally tubular body having at least one open end and a bifurcated portion forming a slot, a side opening, the open slot communicates with both the side opening and the open end, the slot is generally vertical and retains yarn therein in a generally vertical orientation during movement between the side opening and the open end, the junction of the open slot and the open end prevents yarn passage through the open end.

18. The apparatus of claim 17 wherein the apparatus includes means for guiding yarn toward the side opening.

19. The apparatus of claim 18 wherein the means for guiding yarn is comprised of two-wire like members.

* * * * *

UNITED STATES PATENT AND TRADEMARK OFFICE

CERTIFICATE OF CORRECTION

PATENT NO. : 5,212,858

DATED : May 25, 1993

INVENTOR(S) : Larry D. Anderson

It is certified that error appears in the above-identified patent and that said Letters Patent is hereby corrected as shown below:

At column 1, line 61, delete "manipulatior" and insert therefor -- manipulation --.

At column 2, line 11, after the word "Fig." delete the number "4" and insert therefor -- 5 --.

At column 2, line 13, after the word "illustrate" delete the word "illustrates".

At column 2, line 34, after the word "machine" delete the letter "Z" and insert therefor -- 2 --.

At column 2, line 36, after the word "fabric" delete "s" and insert therefor -- 8 --.

At column 2, line 40, after the word "cords" please add -- 6 --.

At column 4, line 4, delete the word "so" and insert therefor -- 80 --.

At column 4, line 5, delete the word "so" and insert therefor -- 80 --.

At column 4, line 18, delete "s" and insert therefor -- 80 --.

At column 5, line 3, delete "FIGURES" and insert therefor -- Figure 8 --.

At column 5, line 6, delete "100" and insert therefor -- 102 --.

UNITED STATES PATENT AND TRADEMARK OFFICE

CERTIFICATE OF CORRECTION

PATENT NO. : 5,212,858

DATED : May 25, 1993

INVENTOR(S) : Larry D. Anderson

It is certified that error appears in the above-identified patent and that said Letters Patent is hereby corrected as shown below:

In claim 11, column 6, line 30, after the words "forming a slot" insert -- and --.

Signed and Sealed this

Twenty-first Day of December, 1993

Bruce Lehman

*Attest:*

BRUCE LEHMAN

*Attesting Officer*

*Commissioner of Patents and Trademarks*